United States Patent [19]

Beaver et al.

[11] 4,002,336

[45] Jan. 11, 1977

[54] TABLE TENNIS TRAINING DEVICE

[76] Inventors: Dennis Beaver, 962 Eden Isle Drive N.E., St. Petersburg, Fla. 33704; J. R. Hensley, 1335 Old Country Drive, Dayton, Ohio 45414; Jerry Duff, 4240 Wagner Road, Dayton, Ohio 45440

[22] Filed: May 12, 1975

[21] Appl. No.: 576,557

[52] U.S. Cl. ..... 273/30; 124/56; 124/72; 124/81

[51] Int. Cl.[2] ..... A63B 39/00

[58] Field of Search ..... 273/29 A, 30, 26 D; 124/51 A, 41 R, 56, 81, 72

[56] References Cited

UNITED STATES PATENTS

| | | | |
|---|---|---|---|
| 2,508,461 | 5/1950 | Lemon | 273/30 |
| 3,089,476 | 5/1963 | Wolverton | 124/51 A X |
| 3,855,988 | 12/1974 | Sweeton | 124/11 R |
| 3,911,888 | 10/1975 | Horvath | 273/30 X |

*Primary Examiner*—Richard C. Pinkham
*Assistant Examiner*—T. Brown
*Attorney, Agent, or Firm*—Walter Becker

[57] ABSTRACT

A table tennis training device for use in connection with a table tennis table, which includes a tennis ball catcher having a pocket for collecting the tennis table ball which is then, due to a suction effect, moved from the pocket into a gun operable to be adjusted in a vertical plane and to pivot back and forth along a horizontal plane. After the ball has entered the gun it is by air under pressure passed through the barrel of the gun and prior to leaving the muzzle of the gun subjected to a spin (English). The training device according to the invention comprises means for varying the spin and also for varying the speed at which the balls follow each other which are shot out of the gun. The device furthermore comprises means for varying the suction and the pressure at which the balls are fired by the gun.

11 Claims, 14 Drawing Figures

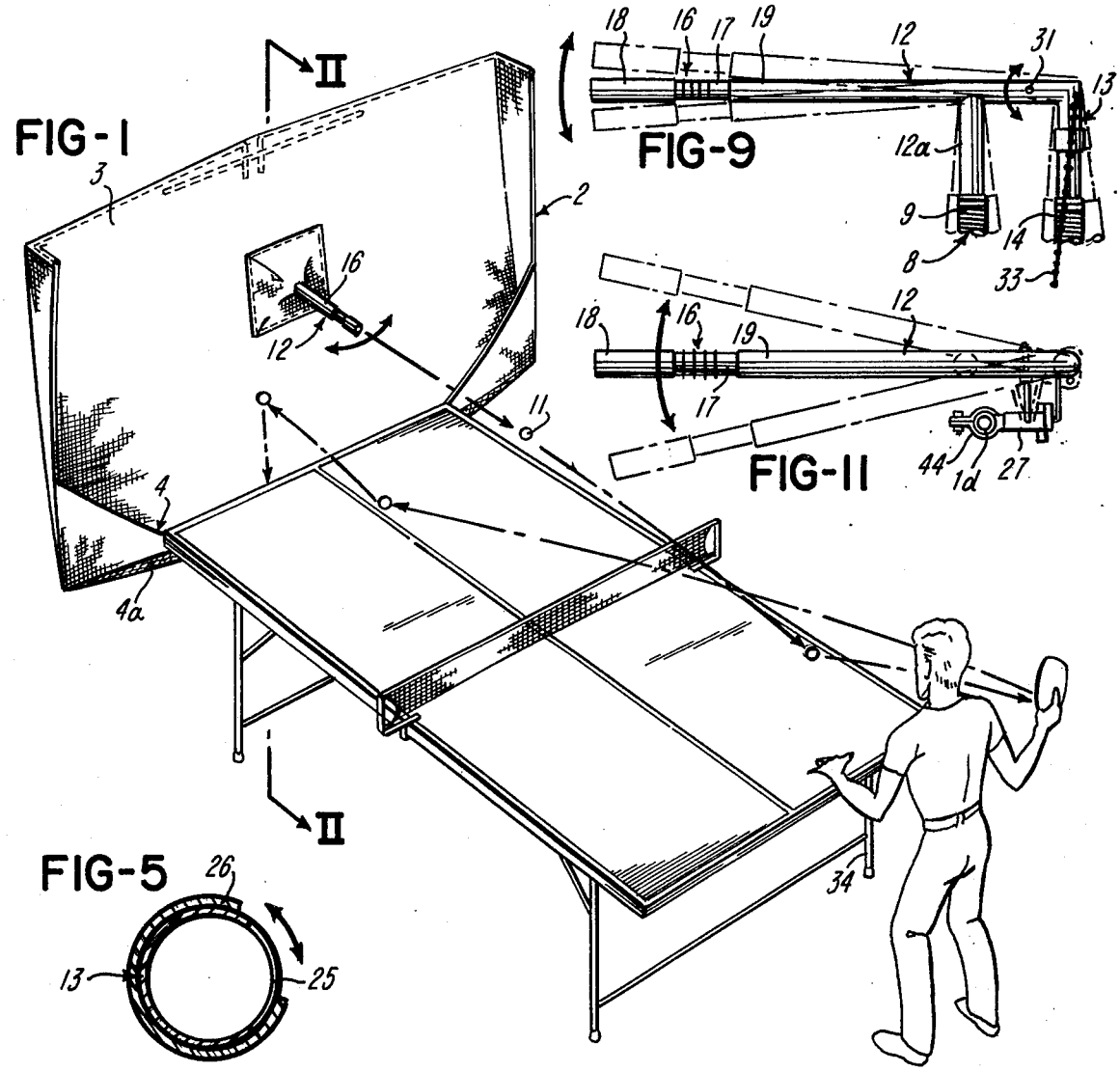
FIG-1
FIG-9
FIG-11
II
3
2
16
12
11
4
4a
34
18
17
19
31
13
12a
9
8
14
33
44
1d
27
FIG-5
26
13
25
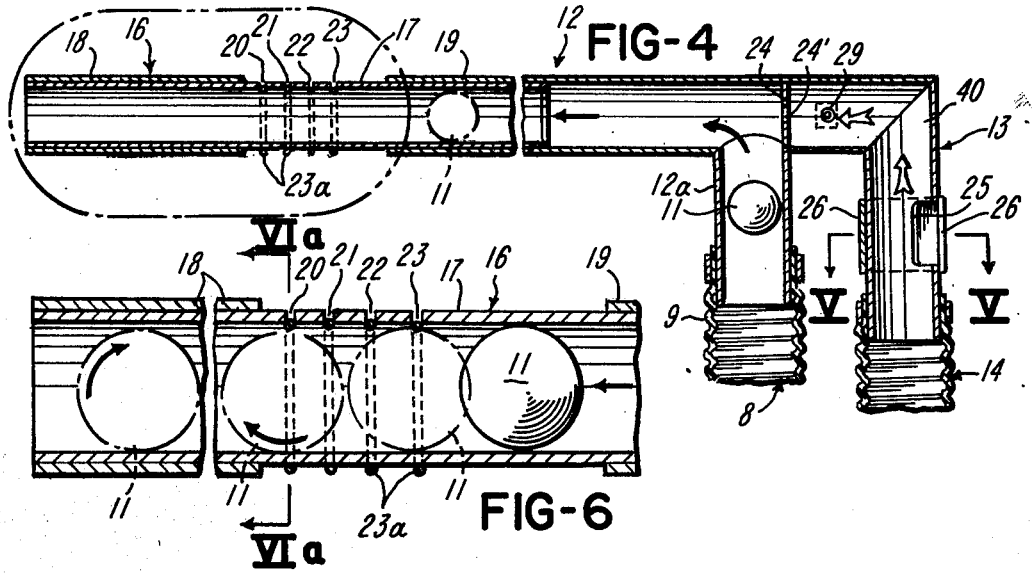
FIG-4
FIG-6
VIa
V
18
16
20
21
22
23
17
19
23a
11
12
24
24'
29
40
13
12a
26
25
9
14
8

FIG-2
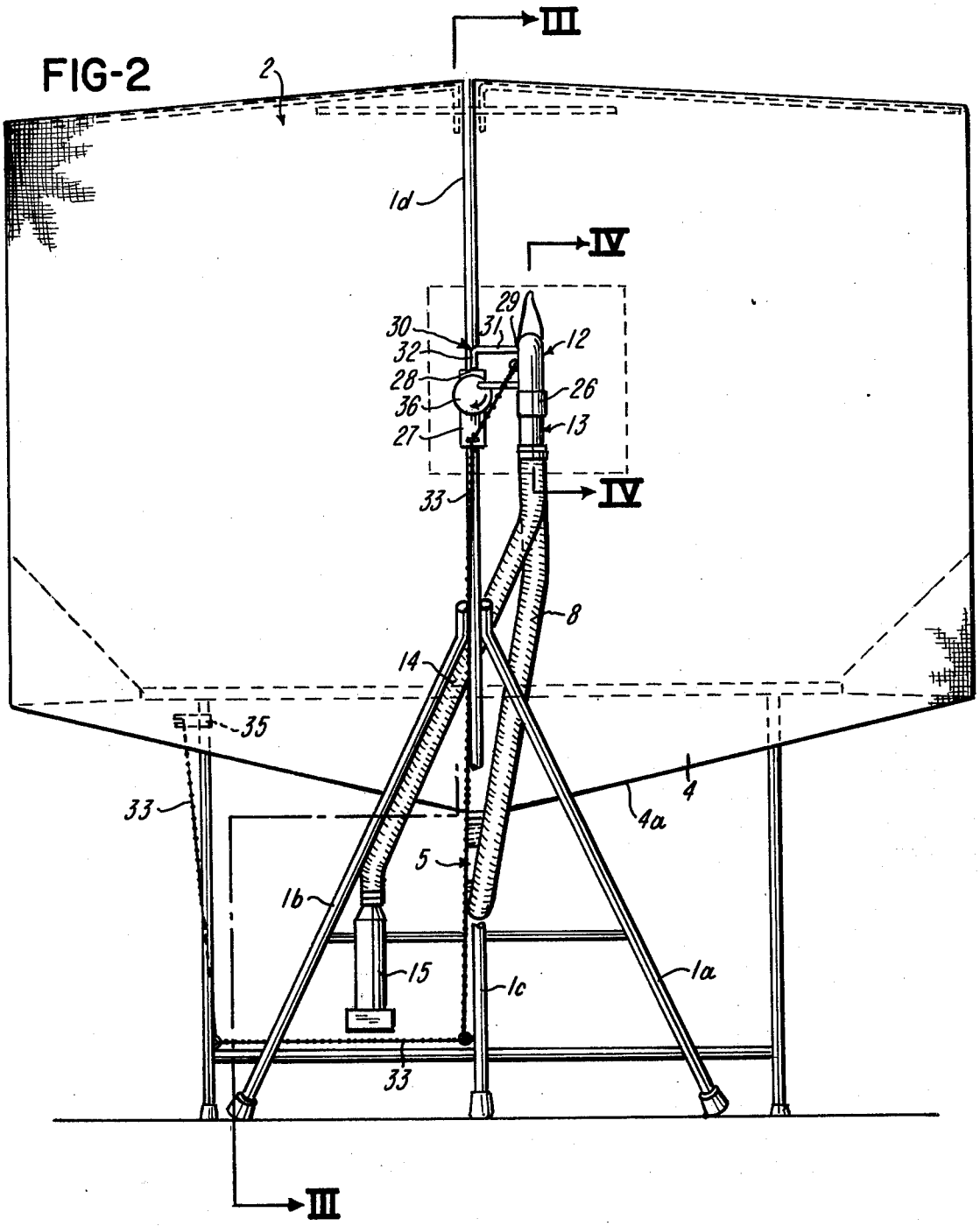
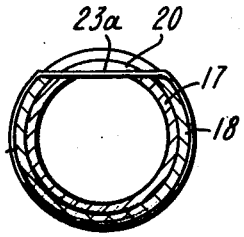
FIG-6a
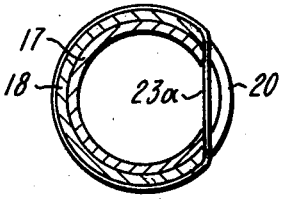
FIG-6b
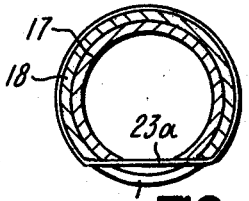
FIG-6c

TABLE TENNIS TRAINING DEVICE

The present invention relates to a table tennis training device for use with regular table tennis tables to permit not only beginners to practice fundamentals of table tennis, but also to give an experienced player the opportunity of improving his strokes and game style.

Devices of this type have been developed in which a plurality of balls are successively thrown onto the training player's field from where the player hits and throws back the ball. The ball is then caught by a catching device, recycled and thrown back to the player.

The heretofore known devices of this type, however, are first of all, too complicated in construction and therefore too expensive. In addition thereto, they lack the necessary automatic variety of ball throw to make the play more realistic.

It is, therefore, an object of the present invention to provide a table tennis training device of the above mentioned general type which will not only be greatly simplified over heretofore known table tennis devices, but will also be able to make the play more realistic while automatically varying the direction in which the ball is thrown.

It is also an object of the invention to provide the device as set forth in the preceding paragraph so as to be able to vary the time interval between succeeding balls thrown by the device.

These and other objects and advantages of the invention will appear more clearly from the following specification, in connection with the accompanying drawings, in which:

FIG. 1 is an isometric overall view of the device according to the present invention.

FIG. 2 shows the device of FIG. 1 as seen along the line II—II of FIG. 1, but is illustrated on a larger scale than that of FIG. 1.

FIG. 4 shows a section taken along the line IV—IV of FIG. 2, but without the back drop or ball catching device.

FIG. 5 is a section taken along the line V—V of FIG. 4, but on a larger scale than that of FIG. 4.

FIG. 6 shows on a larger scale than that of FIG. 4 the dot-dash encircled part of FIG. 4 which represents a device for selectively effecting top spin, under spin, and side spin (English).

FIG. 6*a* is a section taken along the line 6*a*—6*a* of FIG. 6.

FIGS. 6*b* and 6*c* respectively show two different positions of the device of FIG. 6 to effect side spin and top spin respectively.

Figure 7:
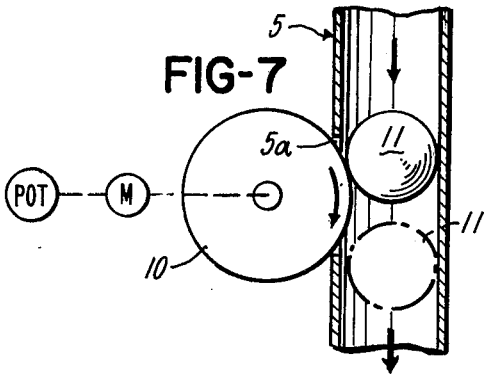

FIG. 7 shows in section a device for adjusting the time interval at which the balls being ejected are being shot out of the barrel of the gun.

Figure 8:
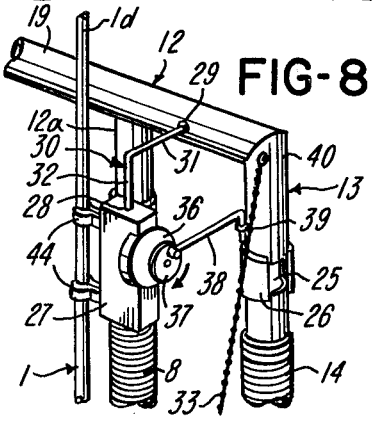

FIG. 8 is a fragmentary isometric view of the device governing the direction from which the ball comes to the player.

FIG. 9 is a view similar to that of FIG. 4 on a somewhat smaller scale than that of FIG. 4 and shows the pivotal adjustment of the gun barrel in the vertical plane.

Figure 10:
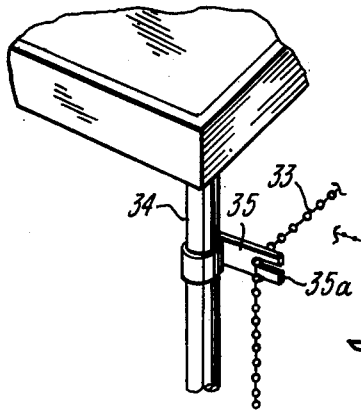

FIG. 10 shows the arrangement for retaining the pivotal adjustment of FIG. 9 at its respective elevation.

FIG. 11 is a top view of FIG. 8, but on a somewhat smaller scale than the latter.

The table tennis training device according to the present invention is characterized primarily in that the balls are picked up from the ball catching device by suction which can easily be varied while the time interval at which the balls are leaving the gun barrel can also easily be varied. Furthermore, simplified means are provided for producing top spin, under spin and side spin, and the gun barrel can easily be adjusted so as to cause the ball leaving the latter to move from the left to the right of the table and vice versa while the trajectory of the ball is variable. Also a low number of balls, e.g. from four to 10 is fully sufficient to make the device operate satisfactorily.

Figure 3:
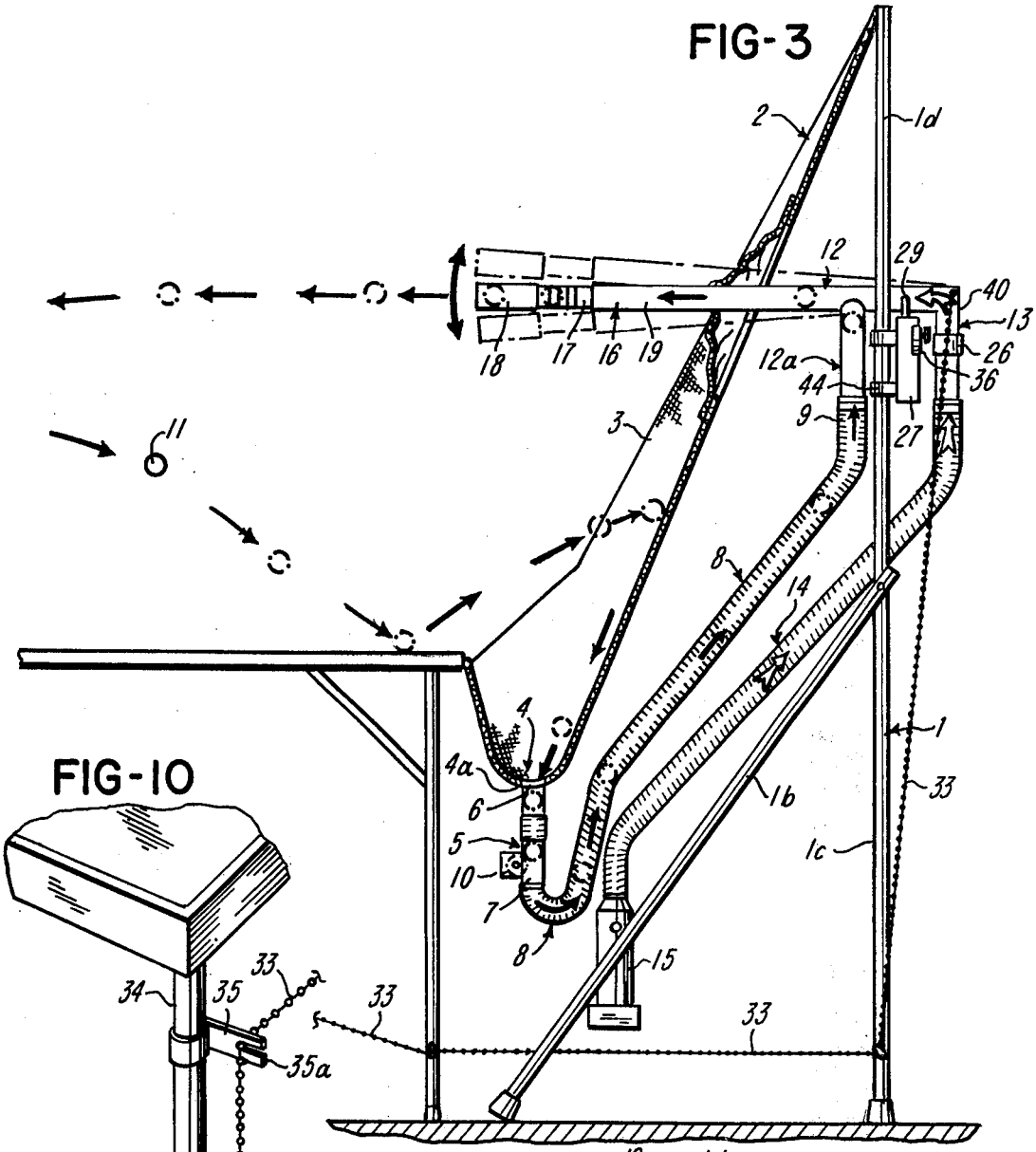
FIG. 3 represents a section through the device according to the invention, said section being taken along the line III—III of FIG. 2.

Referring now to the drawings in detail, the table tennis training device according to the present invention comprises a frame generally designated 1 with, for instance, three legs 1*a*, 1*b* and 1*c*. Leg 1*c* to which the legs 1*a* and 1*b* are fastened in any convenient manner has an upward extension 1*d*, which has preferably detachably connected thereto in any convenient manner a ball catcher 2. This ball catcher which simultaneously forms a part of the recycling device comprises a relatively wide screen or fabric covered frame 3 with a low relatively large pocket 4. The bottom 4*a* of said pocket 4 slopes downwardly toward a tube 5 (FIGS. 2 and 3) having its upper end 6 connected to the bottom of and in communication with said pocket 4. The lower end 7 of tube 5 has connected thereto one end of a preferably flexible hose 8, the other end 9 of which is connected to a tube section 12*a* of a gun 12, (FIG. 4).

As will be evident from FIG. 7, tube 5 has an opening 5*a* through which extends a wheel 10 with an outer circumferential frictional surface for frictional engagement with any ball 11 passing by said opening 5*a*. The friction wheel 10 is rotatably connected to a speed variable motor M and controls the speed of the balls 11 passing by said opening 5*a*. Preferably the outer peripheral surface of said friction wheel 10 consists of somewhat compressible foam rubber material or similar substances. If desired, the entire wheel may be made of urethane foam. It may also be mentioned that the opening 5*a* does for all practical purposes not affect the suction effect, which, as will be explained later, is created in the tube 5 and the hose 8.

That outer end of the gun 12 which is adjacent to the branching-off tube section 12*a* is formed by an elbow 13, which latter through flexible hose 14, is connected to an air blower 15. The size of the air blower 15 which as will likewise be explained in detail later brings about the suction effect in tube 5 and flexible hose 8 is selected so that the opening 5*a* through which the wheel 10 extends will not for all practical purposes effect the suction necessary to draw the balls 11 through tube 5 and hose 8 into the gun 12.

The gun 12 has an extensible barrel 16 which comprises an inner tube 17 and a shorter outer tube 18 which is fixedly connected to the inner tube 17. The outer diameter of the inner tube 17 is so selected that the inner tube 17 frictionally engages the inner surface of gun section 19 so that by grasping and turning the outer tube 18 the inner tube 17 can be turned in the gun section 19, and will remain in its respective position when stopping rotating tube 18. If desired, but not necessarily, the inner tube 17 may be made of the same stock as the gun 12, and after having been provided with a longitudinal slot-like cutout can then be squeezed together to frictionally fit into the gun section 19. A tube section 18 of the same inner diameter as that of gun section 19 is then connected to the inner tube 17 as described above. The outer tube 18 is preferably welded, bonded or soldered to the inner tube 17 or connected thereto in any other suitable manner. That end of the inner tube 17 which is inserted into the gun section 19 has its inner end beveled in the direction toward the tube section 12*a* so as to permit a ball coming from the tube section 12*a* easily to enter the inner tube 17.

Between the outer tube 18 and the adjacent end of the gun section 19 the inner tube 17 is provided with one or more, preferably four tangential slots 20, 21, 22, 23 (FIG. 6 and FIGS. 6*a*, 6*b* and 6*c*.) These slots are located in parallel spaced arrangement to each other, and the bottoms of the slots are located in the same axis parallel plane. In at least one of said slots there is located an elastic band 23*a*, preferably a rubber band, which only slightly extends into the interior of the inner tube 17.

In the specific showing of FIGS. 4 and 6 there is an elastic band 23*a* in each of the four slots 20 to 23, and each band is in the underspin position of FIG. 6*a*. When tube 17 is turned clockwise relative to the position of FIG. 6*a* by 90°, the bands 23*a* will occupy the position shown in FIG. 6*b* (straight side spin), and when tube 17 is turned further in the same direction by 90°, the bands 23*a* will occupy the position shown in FIG. 6*c* (top spin). It will, of course be evident that tube 17 can also be turned to any other position between those shown in FIGS. 6*a*, 6*b*, 6*c* with the result that a corresponding spin will be obtained. As mentioned above, it is not necessary that each slot has an elastic band therein, in some instances less bands, or even one band may suffice. It is furthermore to be understood that four slots are shown only by way of example and that any other desired number of slots may be provided. Furthermore, if a less expensive device will suffice, the tube 17 may form a single integral part with the barrel 19 which may then be provided with one or more non-adjustable slot or slots, in which instance only one specific spin is obtainable.

Between the elbow 13 and the area where the tube section 12*a* leads into the gun section 19 there is provided a partition 24 with a small orifice 24', e.g. with a diameter of ⅝ inch, for a purpose which will become evident further below. The elbow 13 is also provided with a peripheral slot or opening 25 which can be covered to any desired extent by means of a sleeve 26 (see FIGS. 4 and 5), for controlling the air which from the air blower reaches the gun barrel 16. Merely by way of example, a blower may be employed which has the following characteristics: 115V, 60 cycles, 25 cubic feet per minute through a ⅝ inch diameter opening.

Mounted on the upward extension 1*d* is a bracket or support 27 (FIG. 8) with a vertical bore 28. The elbow section 13 of the gun 12 is provided with a transverse bore 29. As will be seen from FIG. 8, an L-shaped pin 30 has one arm 31 pivotally extending through bore 29, whereas the other arm 32 is pivotally journaled in the bore 28. Furthermore, the elbow section 13 has connected thereto a chain 33 which extends in the specific embodiment shown in the drawings to the righthand front corner of the table tennis table, which latter has mounted on its leg 34 a bracket 35 (FIG. 10) with a fork-shaped end 35*a* while the prongs of said fork-shaped end 35*a* are spaced from each other in such a way that when a portion of the chain between the beads is introduced between the prongs, the chain will be locked in its respective position and consequently also the inclination of the barrel 16 will be retained in its respective adjusted position once the chain 33 is latched in the bracket 35.

Furthermore connected to the bracket 27 is a rotary motor 36 with a crank disc 37 having connected thereto a hook 38, the free end of which engages an eye 39 which is fixedly connected to the downwardly extending arm 40 of the elbow 13. It will be appreciated that inasmuch as the hook 30 has a pivotal arm rotatably journaled in the bracket 27 and has a horizontal arm pivotally mounted in the bore 29, rotation of the crank disk 37 will result in the pivoting of the gun in a horizontal plane. Normally, the pivot angle in a horizontal plane of the gun is set, but if the rotary motor 36 is selected as a variable speed motor, the time within which the barrel moves through its maximum pivot angle is variable.

In order to permit the barrel which extends through the ball catcher and, more specifically, through the screen or fabric covered frame 3, to pivot in vertical direction as well as in horizontal direction, the screen or fabric covered frame 3 has a cutout in approximately the central portion thereof, which cutout is then covered by a bellows-shaped pyramid of flexible material.

The operation of the device is as follows: Assuming that the training device according to the present invention has been set up in the manner illustrated in FIG. 1, and that a player now intends to use the device for training, he pulls the chain 33 to thereby set the elevation of the barrel. The player then determines the sequence in which he would like to have the balls thrown at him by the barrel and accordingly adjusts the desired speed of the motor M and thereby the speed of rotation of the friction wheel 10. Thereupon, the motor 36 is started and finally the blower 15 is started, for instance, by an extension cord and switch connected thereto (not shown) from the stand of the player behind the table as it is shown in FIG. 1. As soon as the above mentioned adjustments have been made and the equipment has been started, the air under pressure passed from the blower 15 through hose 14 passes into the elbow section 13 and from there through the orifice 24' into the gun section 19 where the air under pressure passes across the opening where the tube section 12*a* leads into the gun section 19. As a result thereof, a pressure below atmospheric pressure will be created in the tube section 12*a* and consequently in the downwardly extending tube 5 so that balls which were previously deposited in the pocket of the catcher 2 will be drawn into the tube 5 and from there through hose 8 into the barrel 16. While the respective ball passes by the friction wheel 10, it is frictionally engaged and its speed is controlled in conformity with the rotary speed of the friction wheel 10 so that the sequence at which the balls 11 follow each other will be controlled by the speed of the friction wheel 10.

When the ball passes through the barrel 16 and more specifically, by the respective elastic band or bands 23*a*, the ball is slightly braked by said elastic band or bands and thus will obtain a spin depending on the position which the elastic band or bands occupy, e.g. the position of FIG. 6*a*, 6*b* or 6*c*, or any other position set by the respective rotary adjustment of tube 17, 18. The ball leaving the barrel 16 under the influence of the compressed air being supplied by the compressure through orifice 24' into the barrel, will then, while the band moves from one side of the table to the other side of the table, be thrown out of the barrel with the trajectory of the ball determined by the extent to which the barrel is adjusted in the vertical position, and to the extent the barrel moves through a horizontal angle and in conformity with the speed the balls follow each other. Depending on the extent to which the sleeve 26 covers the slot or opening 25, more or less air from the blower is passed into the atmosphere so that to a corresponding extent the subatmospheric pressure in the tube section 13 is changed and also the pressure acting on the ball when moving in the barrel is changed. Just for the sake of completeness and merely by way of example, it may be mentioned that the play between the inner diameter of tube 17 and the outer diameter of ball 11 may be about 30/1000 inch.

The player will, of course, try to hit the oncoming ball under the respective conditions which, as will be evident from the above, very much simulate actual playing conditions. The player can, at his discretion vary the various conditions outlined above and can thereby change the conditions of the game in conformity with what he wants to practice in particular.

Finally, there may be mentioned that the bracket 27 (FIGS. 3 and 8) is by means of clamps 44 (provided with a clamping screw — not shown —) vertically adjustably mounted on the extension 1*d*. Thus, when loosening the clamps 44, it is possible to vertically adjust as a unit the bracket 27 with motor 36, gun 12 with barrel 16, elbow 13 and L-shaped pin 30 and hook 38. When the desired adjustment has been effected, it is merely necessary again to tighten the clamps 44.

It is, of course, to be understood that the present invention is, by no means, limited to the specific showing in the drawings, but also comprises any modifications within the scope of the appended claims.

What we claim is:

1. A table tennis training device for use in connection with a table tennis table, which includes: a stand adapted to be placed at one end of a table tennis table, a tennis ball catcher supported by said stand and comprising a screen having a front side forming the side intended to face the table tennis table in connection with which said training device is to be used, said screen also comprising a rear side and being provided with a pocket on said front side for catching and gathering table tennis balls thrown onto the front side of said screen, a gun supported by said stand and arranged on the rear side of said screen, said gun having a barrel extending from the rear side of said screen through the latter to the front side thereof, first conduit means leading from said pocket to said barrel for establishing communication between said pocket and said barrel and for conveying table tennis balls from said pocket into said barrel, air blower means, second conduit means having one end thereof connected to said air blower means for communication therewith and having its other end connected to said barrel for communication therewith at an area more remote from the front side of said screen than the area where said first conduit leads into said barrel, and a partition with an orifice of substantially smaller diameter than the internal diameter of said second conduit, said partition being interposed between those areas where said first and second conduit means respectively lead into said barrel.

2. A device according to claim 1, in which said gun is pivotable along a horizontal plane, and which includes motor means operatively connected to said gun for pivoting the same back and forth along a portion of a circle.

3. A device according to claim 2, in which said motor means is a variable speed motor.

4. A device according to claim 1, which includes means pivotally engaging said gun for pivoting the same about both a horizontal and a vertical axis.

5. A device according to claim 1, which includes: horizontal pin means supporting said gun for pivotal movement of the latter about a horizontal axis, and adjusting means operatively connected to said gun for pivoting said gun about said pin means to thereby set the elevation of said barrel.

6. A device according to claim 1, in which said gun includes: a barrel comprising a first section and a second section frictionally and telescopically arranged in said first section and partially protruding from said first section, said second section including the muzzle of said gun and being rotatably adjustable relative to said first section, that part of said second section which protrudes from said first section being provided with slot means, and elastic band means arranged in said slot means and partially protruding into the interior of said second section.

7. A device according to claim 1, in which at least a section of said first and second conduit means consists of a flexible hose section.

8. A device according to claim 7, which includes a bracket substantially vertically adjustably connected to said stand and supporting said gun and said motor means.

9. A device according to claim 1, in which said second conduit means has an opening through a wall portion thereof, and which includes closure means associated with said opening and adjustable relative to said opening for selectively opening and closing said opening to any desired extent.

10. A device according to claim 1, in which said first conduit means is provided with a window, and which includes a friction wheel frictionally engaging through said window every table tennis ball passing by said window, and control motor means drivingly connected to said friction wheel for driving the same.

11. A device according to claim 10, in which said control motor means is a variable speed motor.

* * * * *